US006718813B2

(12) United States Patent
Yasuda et al.

(10) Patent No.: US 6,718,813 B2
(45) Date of Patent: Apr. 13, 2004

(54) PIPE RACK FORMING METHOD AND APPARATUS

(75) Inventors: Tsutomu Yasuda, Saitama (JP); Masato Ishikawa, Saitama (JP); Yoshihisa Mikami, Saitama (JP)

(73) Assignee: Showa Corporation (JP)

( * ) Notice: Subject to any disclaimer, the term of this patent is extended or adjusted under 35 U.S.C. 154(b) by 7 days.

(21) Appl. No.: 10/153,937

(22) Filed: May 23, 2002

(65) Prior Publication Data

US 2002/0174702 A1 Nov. 28, 2002

(30) Foreign Application Priority Data

May 28, 2001 (JP) ..... 2001-159581
Mar. 8, 2002 (JP) ..... 2002-064393

(51) Int. Cl.[7] ..... B21D 17/02
(52) U.S. Cl. ..... 72/370.04; 72/370.21; 29/893.34
(58) Field of Search ..... 72/356, 370.04, 72/370.06, 370.21; 29/893.34

(56) References Cited

U.S. PATENT DOCUMENTS 6,575,009 B2 * 6/2003 Shiokawa ..... 72/370.06

FOREIGN PATENT DOCUMENTS

JP 9554 6/1999
JP 58239 8/1999

* cited by examiner

*Primary Examiner*—Lowell A. Larson
(74) *Attorney, Agent, or Firm*—Orum & Roth

(57) ABSTRACT

In a pipe rack forming method, in a state of holding a pipe forming body by a holding portion in a holding metal mold, at a time of pressing a flat surface portion of the pipe forming body by tooth bottom forming surfaces of respective stages of tooth profile portions in a tooth profile metal mold, the structure is made such as to sequentially employ the tooth profile portions in which a tooth bottom height applied to the flat surface portion is reduced in sequence for the tooth profile portions in the tooth profile metal mold, repeatedly pressing and moving forward and backward mandrels having the same size to an inner periphery of the pipe forming body every time when the respective stages of tooth profile portions in the tooth profile metal mold press the flat surface portion, and forming a rack tooth having a final tooth profile.

11 Claims, 8 Drawing Sheets

1
1A
3A
Ha
2A
1B
3B
Hb
2B
Hm
4
3C
4A
Hc
2C
Ht

PIPE RACK FORMING METHOD AND APPARATUS

BACKGROUND OF THE INVENTION

1. Field of the Invention

The present invention relates to a pipe rack forming method and apparatus.

2. Description of the Related Art

In the convention art, there has been a structure described in Japanese Unexamined Patent Publication (JP-A) No. 2001-9554 as a pipe rack forming apparatus for forming a rack tooth having a final tooth profile of a fixed tooth bottom height and tooth top height in a flat surface portion of a pipe forming body, in which the flat surface portion is previously formed in a part of a raw pipe material.

This prior art presses the flat surface portion of the pipe forming body by a tooth bottom forming surface having the same tooth profile portion as the final tooth profile in a tooth profile metal mold, in a state of holding the pipe forming body by a holding portion of a holding metal mold. It sequentially pressure inserts two or more mandrels having diameters from a small diameter to a large diameter to an inner periphery of the pipe forming body so as to press and move forward and backward in a repeated manner. Accordingly, a wall in the flat surface portion of the pipe forming body is casted up from a side of the inner periphery, whereby the rack tooth having the final tooth profile is formed on an outer periphery of the flat surface portion.

In the prior art, a plurality of mandrels of different sizes is required, and many man-hours of labor are required. Further, the flat surface portion of the pipe forming body is pressed by the tooth bottom forming surface having the same tooth profile portion as the final tooth profile in the tooth profile metal mold from the beginning. The mandrel is pressure inserted to the inner periphery of the pressed pipe forming body, so that the first mandrel is structured to have a particularly small diameter which is easily broken due to a buckling failure. Accordingly, the smaller the pipe rack is, the harder the formation becomes.

SUMMARY OF THE INVENTION

An object of the present invention is to easily form a pipe rack while avoiding breakage of the mandrel at a time of forming the pipe rack by using a tooth profile metal mold and the mandrel.

The present invention discloses a pipe rack forming method of forming a rack tooth having a final tooth profile of a fixed tooth bottom height and tooth top height, in a part of a raw pipe material. The pipe rack forming method prepares a tooth profile metal mold having plural stages of tooth profile portions with different height positions of tooth bottom forming surfaces. In a state of the steps include holding a raw pipe material by a holding portion of a holding metal mold, while pressing a part of the raw pipe material by the tooth bottom forming surfaces of the respective stages of tooth profile portions in the tooth profile metal mold. Sequentially tooth profile portions are employed in which the tooth bottom height applied to a part of the raw pipe material is reduced in sequence for the tooth profile portion in the tooth profile metal mold, repeatedly pressing and moving forward and backward a mandrel having the same size to an inner periphery of the raw pipe material every time when the respective stages of tooth profile portions in the tooth profile metal mold press a part of the raw pipe material, and forming a rack tooth having a final tooth profile.

The present invention discloses a pipe rack forming apparatus used for executing the pipe rack forming method with a tooth profile metal mold having plural stages of tooth profile portions. A holding metal mold has plural stages of holding portions individually corresponding to the respective stages of tooth profile portions in the tooth profile metal mold. A pipe pressing and holding means is present for pressing and holding a raw pipe material between the holding portion in the holding metal mold and the tooth profile portion in the tooth profile metal mold in each of the stages. A mandrel pressing and moving forward and backward means is present for pressing and moving forward and backward the mandrel to an inner periphery of the raw pipe material. The raw pipe material formed by using the front stage of the tooth profile portion in the tooth profile metal mold, is transferred between the holding portion in the rear stage of holding metal mold and the tooth profile portion in the tooth profile metal mold and is pressed and held by the pipe pressing and holding means. The mandrel is pressed and moved forward and backward to the raw pipe material by the mandrel pressing and moving forward and backward means.

The present invention also discloses a pipe rack forming apparatus used for executing the pipe rack forming method having a tooth profile metal mold with plural stages of tooth profile portions. A holding metal mold is present having one holding portion commonly corresponding to the respective stages of tooth profile portions in the tooth profile metal mold. A pipe pressing and holding means is present for pressing and holding a raw pipe material between the common holding portion in the holding metal mold and the tooth profile portion in each of the stages of tooth profile metal molds. A mandrel pressing and moving forward and backward means is also present for pressing and moving forward and backward the mandrel to an inner periphery of the raw pipe material. A rear stage of the forming portion in the forming metal mold is positioned with respect to the raw pipe material so as to be pressed and held by the pipe pressing and holding means while holding the raw pipe material formed by using the front stage of the tooth profile portion in the tooth profile metal mold in the holding portion in the holding metal mold. The mandrel is pressed and moved forward and backward with respect to the raw pipe material by the mandrel pressing and moving forward and backward means.

The present invention discloses a pipe rack forming method of forming, from a raw pipe material, a rack tooth having a final tooth profile of a fixed tooth bottom height and tooth top height, in a part of the raw pipe material. The method utilizes a tooth profile metal mold in which a tooth profile portion is capable of being displaced with respect to a tooth profile metal mold main body, and a height position of a tooth bottom forming surface in the tooth profile portion is capable of being controlled. The raw pipe material is held by a holding portion of a holding metal mold and a tooth profile metal mold main body of the tooth profile metal mold, while pressing a part of the raw pipe material by the tooth bottom forming surface of the tooth profile portion in the tooth profile metal mold. The tooth profile portion is controlled so that the tooth bottom height applied to a part of the raw pipe material by the tooth profile portion of the tooth profile metal mold is reduced in sequence, by repeatedly pressing and moving forward and backward a mandrel having the same size to an inner periphery of the raw pipe material every time when the tooth profile portion in the tooth profile metal mold presses a part of the raw pipe material, thereby forming a rack tooth having a final tooth profile.

The present invention also discloses a pipe rack forming method of forming, from a raw pipe material, a rack tooth having a final tooth profile of a fixed tooth bottom height and tooth top height, in a part of the raw pipe material. The method utilizes a tooth profile metal mold in which a tooth profile portion is capable of being displaced with respect to a tooth profile metal mold main body, and a height position of a tooth bottom forming surface in the tooth profile portion is capable of being controlled. The raw pipe material is held by a holding portion of a holding metal mold and a tooth profile metal mold main body of the tooth profile metal mold, while pressing a part of the raw pipe material by the tooth bottom forming surface of the tooth profile portion in the tooth profile metal mold. The tooth profile portion is controlled so that the tooth bottom height applied to a part of the raw pipe material by the tooth profile portion of the tooth profile metal mold is reduced in sequence, alternately repeating an operation of moving forward by pressing and moving backward by pressing a mandrel having the same size to an inner periphery of the raw pipe material every time when the tooth profile portion in the tooth profile metal mold presses a part of the raw pipe material, thereby forming a rack tooth having a final tooth profile.

BRIEF DESCRIPTION OF THE DRAWINGS

The present invention will be more fully understood from the detailed description given below and from the accompanying drawings which should not be taken to be a limitation on the invention, but are for explanation and understanding only.

The drawings

FIGS. 2A and 2B show a metal mold and a mandrel according to a first embodiment, in which FIG. 2A is a front elevational view showing the tooth profile metal mold and a holding metal mold, and FIG. 2B is a plan view obtained by viewing the mandrel from an upper side;

FIGS. 6A and 6B show a metal mold and a mandrel according to a second embodiment, in which FIG. 6A is a front elevational view showing a tooth profile metal mold and a holding metal mold, and FIG. 6B is a plan view obtained by seeing the mandrel from an upper side;

DESCRIPTION OF THE PREFERRED EMBODIMENTS (First Embodiment) (FIGS. 1 to 5C)

Figure 3:
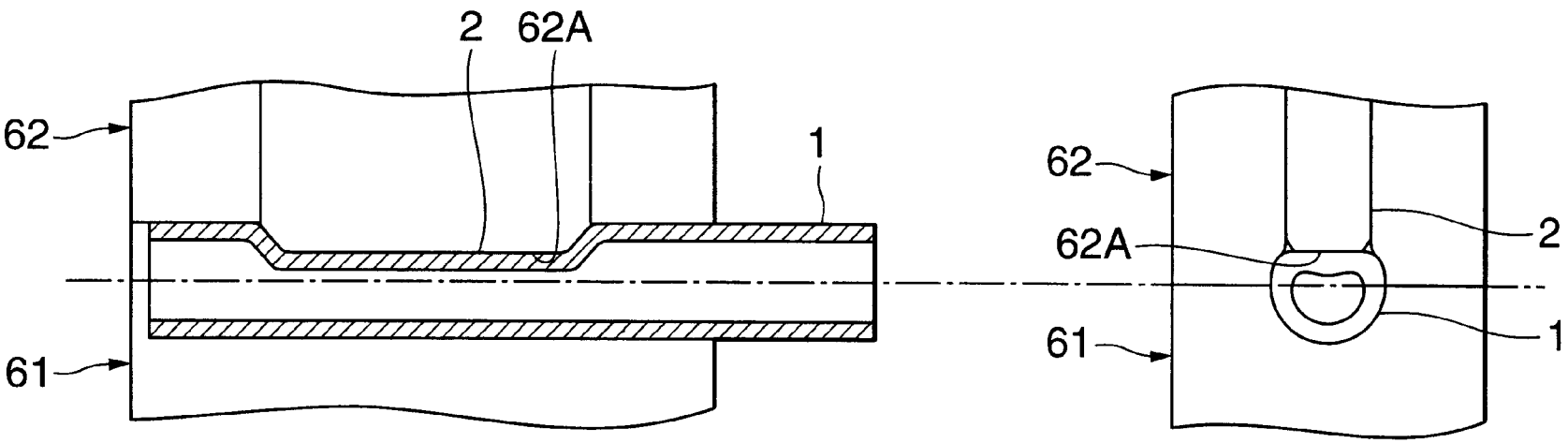
FIG. 3 is a schematic view showing a flat surface forming state of a pipe forming body.
Figures 4A, 4B, 4C:
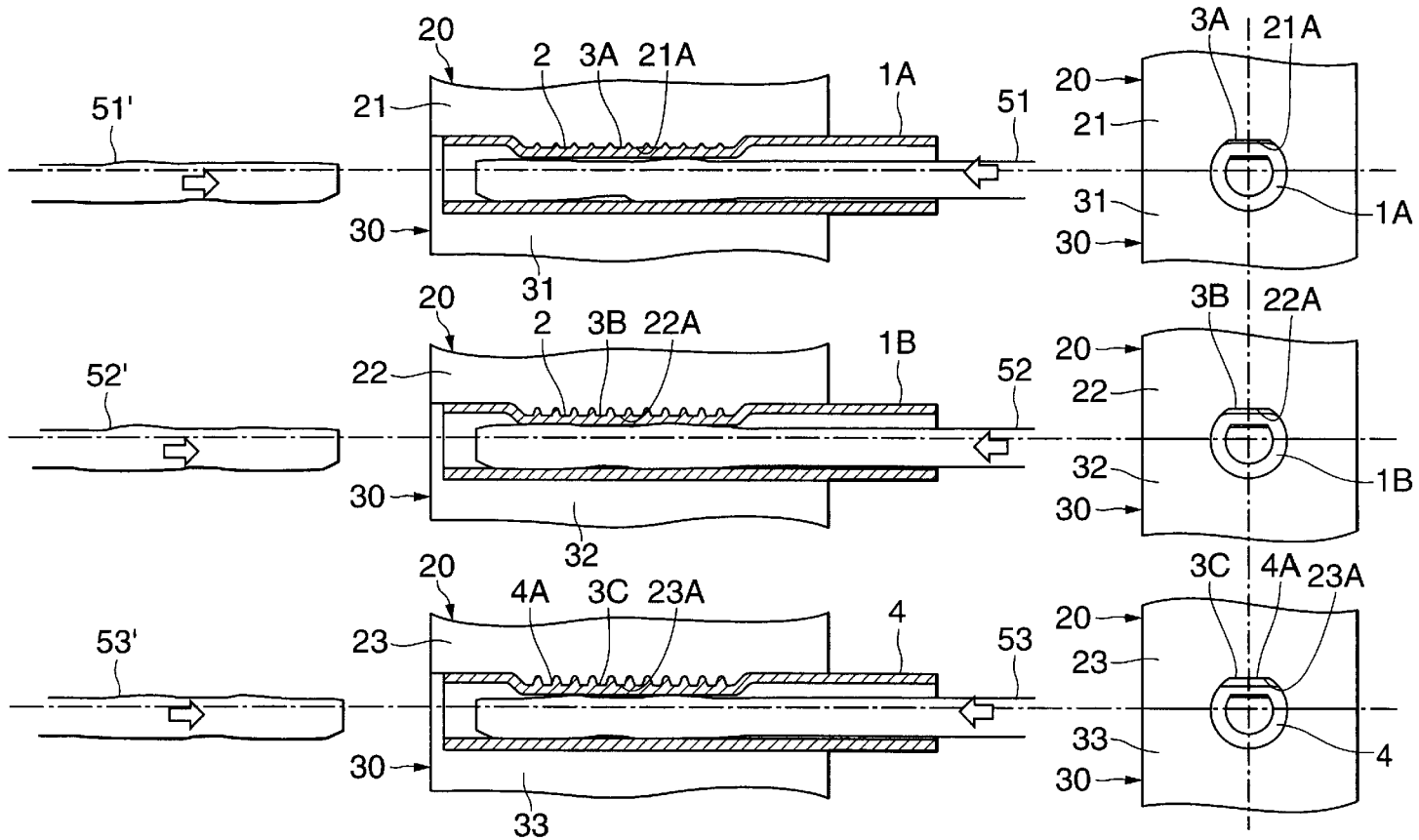
FIGS. 4A to 4C are schematic views showing a tooth profile forming state in respective steps of the pipe forming body.

A pipe rack forming apparatus 10 forms a rack tooth 4A of a pipe rack 4 having a convex-shaped final tooth profile 3C of fixed tooth bottom height Hc and tooth top height Ht in a pipe forming body 1 in which a flat surface portion 2 is previously formed in a part of a raw pipe material, as shown in FIGS. 3 to 4C. In the present embodiment, a standard height position of the tooth bottom height Hc and the tooth top height Ht is defined on the outer surface in an opposite side to the flat surface portion 2 of the pipe forming body 1. However, this standard height position may be set at an optional position of the pipe forming body 1.

Figure 1:
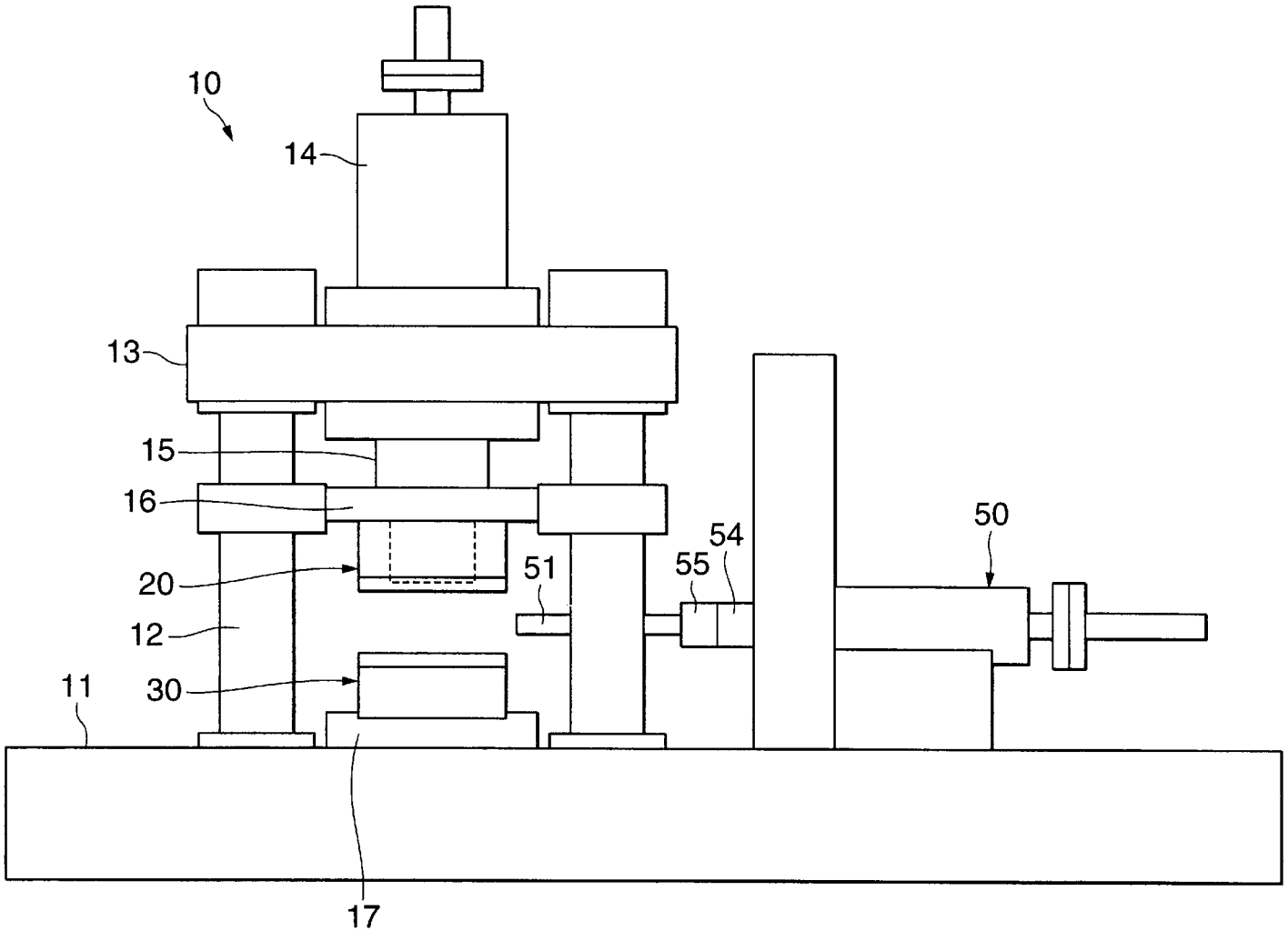
FIG. 1 is a side elevational view showing a pipe rack forming apparatus.

The pipe rack forming apparatus 10 is structured such that a tie plate 13 is fixed to an upper portion of a guide post 12 provided in a base table 11 in a standing manner. A pipe pressing and holding apparatus 14 constituted by a hydraulic servo cylinder, a screw press or the like is placed in the tie plate 13. A plunger 15 of the pipe pressing and holding apparatus 14 can be moved upward and downward due to hydraulic pressure, and a saddle 16 provided in the plunger 15 is guided by the guide post 12, as shown in FIG. 1. A tooth profile metal mold 20 is detachably placed on a lower surface of the plunger 15.

Alternatively, the pipe rack forming apparatus 10 is structured such that an anvil 17 is fixed to a portion immediately below the plunger 15 in the pipe pressing and holding apparatus 14, and a holding metal mold 30 is detachably placed on an upper surface of the anvil 17.

Figure 2A:
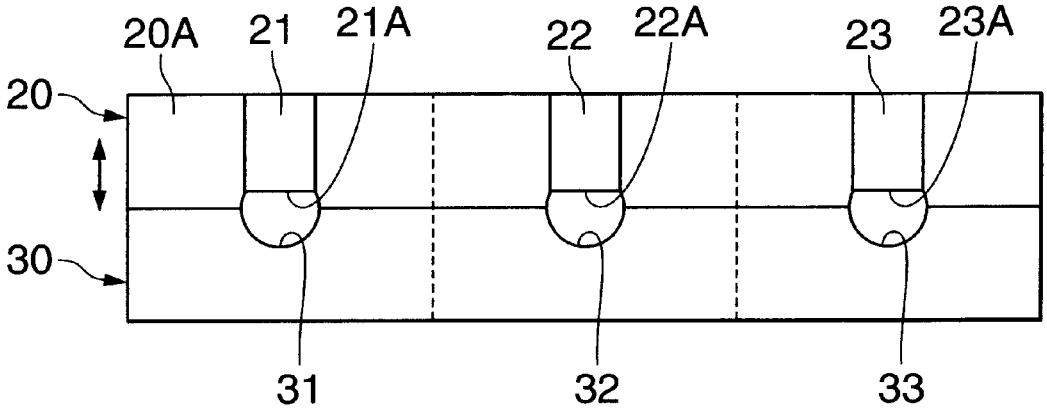
Figure 2B:
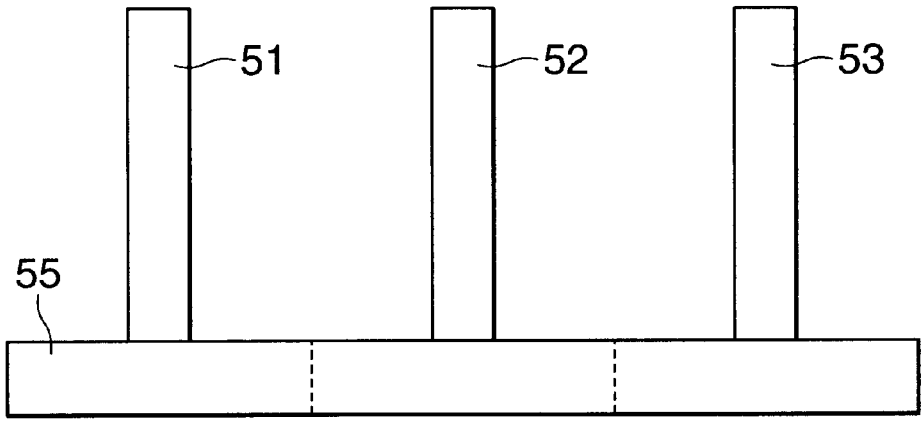

As shown in FIGS. 2A and 2B, the tooth profile metal mold 20 has plural steps of, in the present invention, first to third convex-shaped continuous tooth profile portions 21 to 23 in a tooth profile metal mold main body 20A. The respective steps of tooth profile portions 21 to 23 are provided with tooth bottom forming surfaces 21A to 23A having different height positions (which become smaller so that the tooth bottom forming heights of the tooth bottom forming surfaces 21A to 23A are descended in sequence), and convex-shaped tooth profiles 3A to 3C (which are descended so that tooth bottom heights Ha to Hc of the respective tooth profiles 3A to 3C become smaller in sequence, as shown in FIGS. 4A to 5C) are formed in the flat surface portion 2 of the pipe forming body 1.

The holding metal mold 30 has plural stages of holding portions 31 to 33 individually corresponding to the tooth bottom forming surface 21 to 23 in the respective stages of the tooth profile metal mold 20, as shown in FIGS. 2A and 2B. The respective holding portions 31 to 33 are formed in the same shape, and support an outer periphery except the flat surface portion 2 of the pipe forming body 1, which is a circular arc outer periphery in the present embodiment.

The pipe pressing and holding apparatus 14 moves the respective stages of tooth profile portions 21 to 23 of the tooth profile metal mold 20 close to and apart from the pipe forming body 1 held to the respective stages of holding portions 31 to 33 of the holding metal mold 30, according to upward and downward movements of the plunger 15. Also, the pipe and holding apparatus 14 presses and holds the pipe forming body 1 between the respective stages of tooth profile portions 21 to 23 and the respective stages of holding portions 31 to 33.

The pipe rack forming apparatus 10 is structured such that a mandrel pressing and moving forward and backward apparatus 50 constituted by a hydraulic cylinder is placed in a side portion of the pipe pressing and holding apparatus 14 in the base table 11, and a mandrel table 55 is detachably placed in a plunger 54 of the mandrel pressing and moving forward and backward apparatus 50. The mandrel table 55 is provided with mandrels 51 to 53 which are pressed into to the inner peripheries of the respective pipe forming bodies 1 pressed and held between the respective stages of tooth profile portions 21 to 23 in the tooth profile metal mold 20 and the respective stages of holding portions 31 to 33 in the holding metal mold 30 so as to be pressed and moved forward and backward (moved forward in a pressed manner and moved backward in a pressed manner), as shown in FIGS. 2A and 2B. The mandrels 51 to 53 are respectively formed in a core bar shape. They are provided with forming convex portions in which outer diameters of parts in an axial direction thereof are formed in an expanded diameter shape. The same mandrel height Hm is formed by these forming convex portions. The respective mandrels 51 to 53 cast up the walls of the pipe forming bodies 1 to an outer side by the forming convex portions thereof passing through the inner peripheries of the pipe forming bodies 1, in a step of being pressed into the inner peripheries of the pipe forming bodies 1 so as to be pressed and moved forward and backward.

The pipe rack forming apparatus 10 has a work transfer apparatus (not shown), and can transfer the pipe forming bodies 1 formed by using the front stages of tooth profile portions 21 and 22 in the tooth profile metal mold 20 between the rear stages of tooth profile portions 22 and 23 in the tooth profile metal mold 20, and the rear stages of holding portions 32 and 33 in the holding metal mold 30.

The forming procedure of the pipe rack 4 executed by the pipe rack forming apparatus 10 is as follows.

(1) The flat surface portion 2 is formed in a part of the raw pipe material, and the pipe forming body 1 is obtained (FIG. 3). The pipe forming body 1 may be structured as shown in FIG. 3 such that a holding metal mold 61 is placed in the anvil 17 of the pipe rack forming apparatus 10. A pressure application metal mold 62 is placed in the plunger 15, and the flat surface portion 2 is formed by a pressure application forming surface 62A of the holding metal mold 61.

Figures 5A, 5B, 5C:
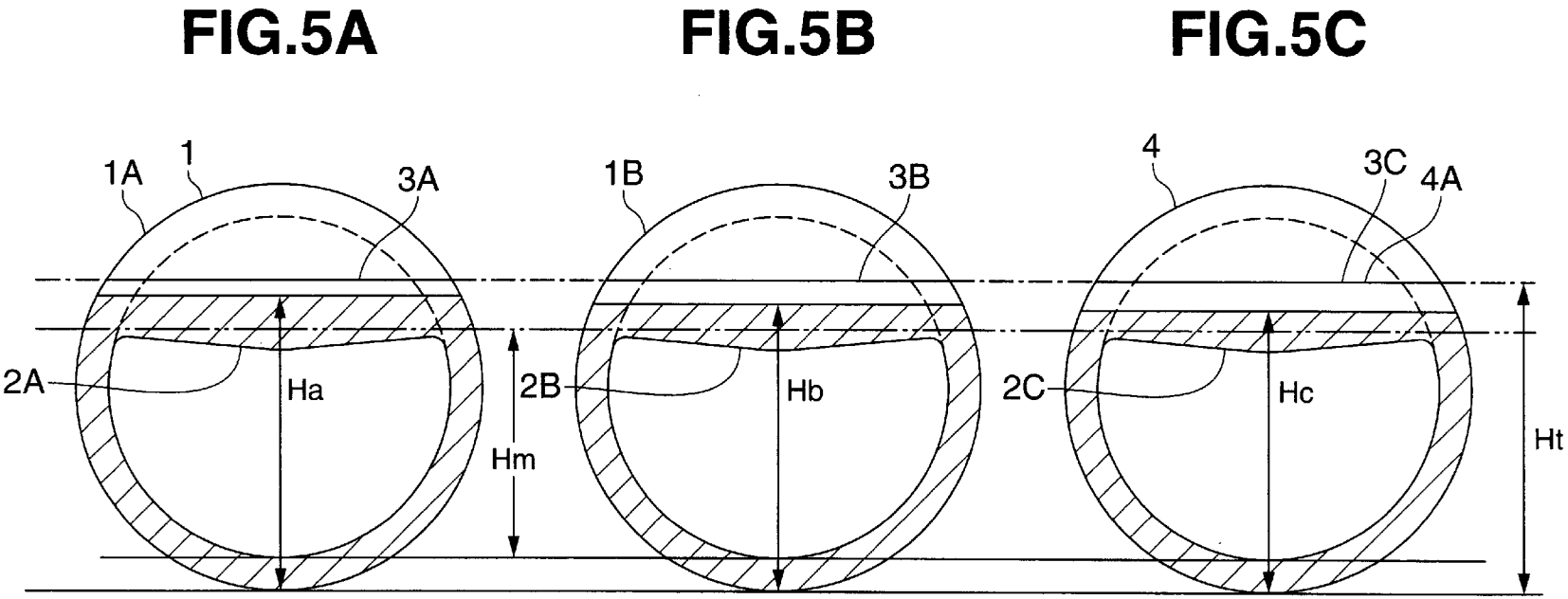
FIGS. 5A to 5C are schematic views showing a tooth profile forming cross section in respective steps of the pipe forming body.

(2) While holding the pipe forming body 1 by the first stage of holding portion 31 in the holding metal mold 30, the flat surface portion 2 of this pipe forming body 1 is pressed by the tooth bottom forming surface 21A in the first stage of tooth profile portion 21 of the tooth profile metal mold 20 by means of the pipe pressing and holding apparatus 14, so as to stamp (FIG. 4A). The tooth bottom forming surface 21A in the tooth profile portion 21 can form the tooth profile 3A in which the tooth bottom forming height is largest and the tooth bottom height Ha is largest, as shown in FIG. 5A. A height formed by the inner peripheral surface 2A of the stamped flat surface portion 2 in the pipe forming body 1 with respect to the inner surface in the opposite side becomes lower than the height Hm of the mandrel 51.

(3) The mandrel 51 is pressed into the inner periphery of the pipe forming body 1, which is pressed and held between the tooth profile portion 21 in the tooth profile metal mold 20 and the holding portion 31 in the holding metal mold 30 in the item (2) mentioned above by the mandrel pressing and moving forward and backward apparatus 50 so as to be pressed and moved forward and backward (be moved forward in the pressed state and be moved backward in the pressed state). The wall of the flat surface portion 2 is casted up so as to be inserted to a recess portion between adjacent convex shapes in the tooth profile portion 21, whereby the tooth profile 3A having the tooth bottom height Ha is formed. Accordingly, a first intermediate pipe forming body 1A is obtained.

(4) The first intermediate pipe forming body 1A obtained according to the item (3) mentioned above is transferred to a portion between the second stage of holding portion 32 in the holding metal mold 30 and the second stage of tooth profile portion 22 in the tooth profile metal mold 20. The flat surface portion 2 (the tooth profile 3A) of the first intermediate pipe forming body 1A is pressed by the tooth bottom forming surface 22A of the tooth profile portion 22 in the tooth profile metal mold 20 by means of the pipe pressing and holding apparatus 14, so as to be stamped in a state in which the first intermediate pipe forming body 1A is held by the holding portion 32 of the holding metal mold 30 (FIG. 4B). The tooth bottom forming surface 22A of the tooth profile portion 22 can form a tooth profile 3B in which the tooth bottom forming height is second largest and the tooth bottom height Hb is second largest (the tooth bottom height Hb is lower than the tooth bottom height Ha of the tooth profile 3A), as shown in FIG. 5B. A height which an inner peripheral surface 2B of the stamped flat surface portion 2 in the first intermediate pipe forming body 1A forms with respect to the inner surface in the opposite side becomes lower than the height Hm of the mandrel 52.

(5) The mandrel 52 is pressed into the inner periphery of the first intermediate pipe forming body 1A which is pressed and held between the tooth profile portion 22 in the tooth profile metal mold 20 and the holding portion 32 in the holding metal mold 30 in the item (4) mentioned above by the mandrel pressing and moving forward and backward apparatus 50 so as to be pressed and moved forward and backward (be moved forward in the pressed state and be moved backward in the pressed state). The wall of the flat surface portion 2 (the tooth profile 3A) is casted up so as to be inserted to a recess portion between adjacent convex shapes in the tooth profile portion 22, whereby the tooth profile 3B having the tooth bottom height Hb is formed. Accordingly, a second intermediate pipe forming body 1B is obtained.

(6) The forming operations in the items (4) and (5) mentioned above are repeatedly applied to the second intermediate pipe forming body 1B obtained in the item (5) mentioned above, and the rack tooth 4A having the final tooth profile 3C is formed. According to the present embodiment, one forming operation using the third stage of tooth profile portion 23 in the tooth profile metal mold 20, the third stage of holding portion 33 in the holding metal mold 30 and the mandrel 53 is repeatedly applied. The flat surface portion 2 (the tooth profile 3B) of the second intermediate pipe forming body 1B is stamped by the tooth bottom forming surface 23A in the tooth profile portion 23 while being held by the holding portion 33. The mandrel 53 is pressed into the inner periphery of the second intermediate pipe forming body 1B (the inner peripheral surface 2C is lower than the height Hm of the mandrel 52) so as to be pressed and moved forward and backward (be moved forward in the pressed state and be moved backward in the pressed state). Accordingly, the rack tooth 4A having the final tooth profile 3C of the tooth bottom height Hc (the tooth bottom height Hc is lower than the tooth bottom height Hb of the tooth profile 3B) is obtained (FIGS. 4C and 5C).

In this case, in the pipe rack forming apparatus 10, the pressing and moving forward and backward operation of the mandrel with respect to the inner peripheries of the pipe forming bodies 1, 1A and 1B may be executed by alternately pressure inserting two mutually opposing mandrels 51 and 51', 52 and 52', and 53 and 53' from both end sides of the pipe forming bodies 1, 1A and 1B, as shown in FIGS. 4A to 4C.

According to the present embodiment, the following effects can be obtained.

1) The tooth profile metal mold 20 has the plural stages of tooth profile portions 21 to 23, and the height positions of the tooth bottom forming surfaces 21A to 23A in the respective stages of tooth profile portions 21 to 23 are different. Further, while pressing the flat surface portion 2 of the pipe forming body 1 by the tooth bottom forming surfaces 21A to 23A of the respective stages of tooth profile portions 21 to 23 in the tooth profile metal mold 20, the tooth profile portions 21 to 23 of the tooth profile metal mold 20 sequentially employ the tooth profile portions 21 to 23 in which the tooth bottom height applied to the flat surface portion 2 is reduced in sequence. The mandrels 51 to 53 having the same size are repeatedly pressed and moved forward and backward (moved forward in the pressed state and moved backward in the pressed state) to the inner periphery of the pipe forming body 1 every time when the respective stages of tooth profile portions 21 to 23 in the tooth profile metal mold 20 press the flat surface portion 2. Accordingly, it is possible to set a stamping amount of the pipe forming body 1 applied by the respective stages of tooth profile portions 21 to 23 in the tooth profile metal mold 20 to be relatively small without initially making the stamping amount excessive enough to correspond to the tooth bottom height of the final tooth profile. It is not necessary to particularly reduce the diameters of the mandrels 51 to 53 pressed into the inner periphery of the pipe forming body 1 stamped by the respective stages of tooth profile portions 21 to 23. It is possible to prevent the mandrels 51 to 53 from being broken, and to easily form the pipe rack 4 having a small diameter.

2) It is possible to employ the mandrels having the same size for the mandrels 51 to 53 pressed into the inner periphery of the pipe forming body 1 pressed by the respective stages of tooth profile portions 21 to 23 in the tooth profile metal mold 20. Thus it is possible to easily form the pipe rack 4.

3) The structure is made such as to have the tooth profile metal mold 20 having the plural stages of tooth profile portions 21 to 23, and the holding metal mold 30 having the plural stages of holding portions 31 to 33 individually corresponding to the respective stages of tooth profile portions 21 to 23 in the tooth profile metal mold 20. Transfer occurs of the pipe forming body 1 formed by using the front stage of tooth profile portions 21 and 22 in the tooth profile metal mold 20 to the portion between the holding portions 32 and 33 of the rear stage of the holding metal mold 30 and the tooth profile portions 22 and 23 of the tooth profile metal mold 20. Accordingly, it is possible to smoothly repeat the forming operation executed by the respective stages of tooth profile portions 21 to 23, and it is possible to improve a productivity of the pipe rack 4.

Figure 6A:
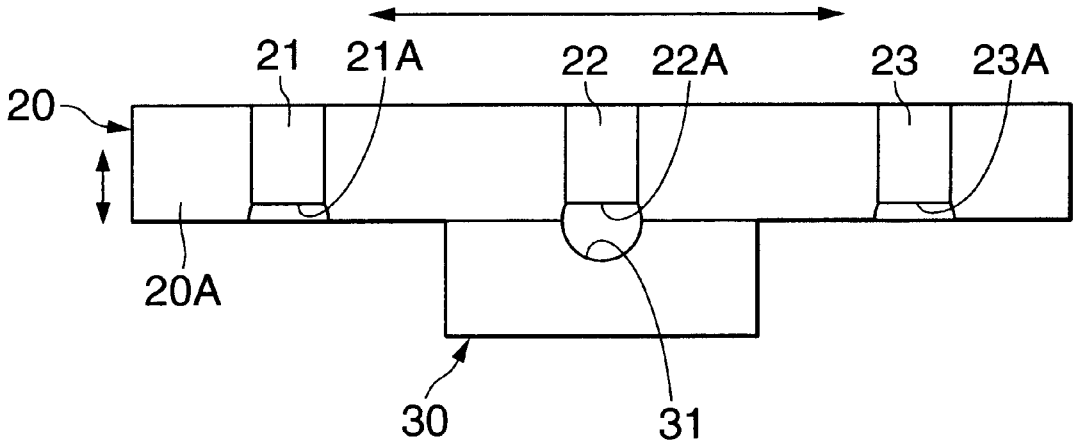
Figure 6B:
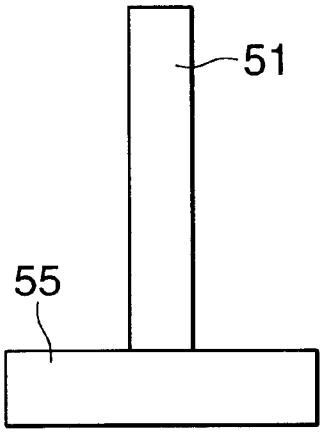

(Second Embodiment) (FIGS. 6A and 6B)

A pipe rack forming apparatus 10 according to a second embodiment is different from the pipe rack forming apparatus 10 according to the first embodiment. Here, the holding metal mold 30 has only one holding portion 31, the mandrel pressing and moving forward and backward apparatus 50 has only one mandrel 51, and the holding portion 31 and the mandrel 51 commonly correspond to each of the respective stages of tooth profile portions 21 to 23 in the tooth profile metal mold 20. Accordingly, the pipe rack forming apparatus 10 according to the second embodiment is provided with a tooth profile metal mold horizontally moving apparatus (not shown). This is constituted by a hydraulic cylinder and the like, which sequentially positions the respective tooth profile portions 21 to 23 of the tooth profile metal mold 20 at forming operation positions which is defined on the same axis as that of the holding portion 31 of the holding metal mold 30 and the mandrel 51 of the mandrel pressing and moving forward and backward apparatus 50.

A forming procedure of the pipe rack 4 executed by the pipe rack forming apparatus 10 according to the second embodiment is as follows.

(1) The flat surface portion 2 is formed in a part of the raw pipe material, and the pipe forming body 1 is obtained (FIG. 3).

(2) In a state of holding the pipe forming body 1 by the holding portion 31 in the holding metal mold 30, the flat surface portion 2 of this pipe forming body 1 is pressed by the tooth bottom forming surface 21A in the first stage of the tooth profile portion 21 of the tooth profile metal mold 20 by means of the pipe pressing and holding apparatus 14 so as to stamp. The tooth bottom forming surface 21A in the tooth profile portion 21 can form the tooth profile 3A in which the tooth bottom forming height is largest and the tooth bottom height Ha is largest, as shown in FIG. 5A. A height formed by the inner peripheral surface 2A of the stamped flat surface portion 2 in the pipe forming body 1 with respect to the inner surface in the opposite side which becomes lower than the height Hm of the mandrel 51.

(3) The mandrel 51 is pressure inserted to the inner periphery of the pipe forming body 1 which is pressed and held between the tooth profile portion 21 in the tooth profile metal mold 20 and the holding portion 31 in the holding metal mold 30 in the item (2) mentioned above by the mandrel pressing and moving forward and backward apparatus 50 so as to be pressed and moved forward and backward (be moved forward in the pressed state and be moved backward in the pressed state), and the wall of the flat surface portion 2 is casted up so as to be inserted to a recess portion between adjacent convex shapes in the tooth profile portion 21, whereby the tooth profile 3A having the tooth bottom height Ha is formed. Accordingly, a first intermediate pipe forming body 1A is obtained.

(4) In the state in which the first intermediate pipe forming body 1A obtained according to the item (3) mentioned above is held in the holding portion 31 of the holding metal mold 30, the second stage of the tooth profile portion 22 of the tooth profile metal mold 20 is positioned with respect to the first intermediate pipe forming body 1A, and the flat surface portion 2 (the tooth profile 3A) of the first intermediate pipe forming body 1A is pressed by the tooth bottom forming surface 22A of the tooth profile portion 22 in the tooth profile metal mold 20 by means of the pipe pressing and holding apparatus 14 so as to be stamped. The tooth bottom forming surface 22A of the tooth profile portion 22 can form a tooth profile 3B in which the tooth bottom forming height is second largest and the tooth bottom height Hb is second largest (the tooth bottom height Hb is lower than the tooth bottom height Ha of the tooth profile 3A), as shown in FIG. 5B. A height which an inner peripheral surface 2B of the stamped flat surface portion 2 in the first intermediate pipe forming body 1A forms with respect to the inner surface in the opposite side becomes lower than the height Hm of the mandrel 52.

(5) The mandrel 51 is pressure inserted to the inner periphery of the first intermediate pipe forming body 1A which is pressed and held between the tooth profile portion 22 in the tooth profile metal mold 20 and the holding portion 31 in the holding metal mold 30 in the item (4) mentioned above by the mandrel pressing and moving forward and backward apparatus 50 so as to be pressed and moved forward and backward (be moved forward in the pressed state and be moved backward in the pressed state), and the wall of the flat surface portion 2 (the tooth profile 3A) is casted up so as to be inserted to a recess portion between adjacent convex shapes in the tooth profile portion 22, whereby the tooth profile 3B having the tooth bottom height Hb is formed. Accordingly, a second intermediate pipe forming body 1B is obtained.

(6) The forming operations in the items (4) and (5) mentioned above are repeatedly applied to the second intermediate pipe forming body 1B obtained in the item (5) mentioned above, and the rack tooth 4A having the final tooth profile 3C is formed. According to the present embodiment, one forming operation using the third stage of tooth profile portion 23 in the tooth profile metal mold 20, the holding portion 31 in the holding metal mold 30 and the mandrel 51 is repeatedly applied, the flat surface portion 2 (the tooth profile 3B) of the second intermediate pipe forming body 1B is stamped by the tooth bottom forming surface 23A in the tooth profile portion 23 in the state of being held by the holding portion 31, and the mandrel 53 is pressure inserted to the inner periphery of the second intermediate pipe forming body 1B (the inner peripheral surface 2C is lower than the height Hm of the mandrel 52) so as to be pressed and moved forward and backward (be moved forward in the pressed state and be moved backward in the pressed state), whereby the rack tooth 4A having the final tooth profile 3C of the tooth bottom height Hc (the tooth bottom height Hc is lower than the tooth bottom height Hb of the tooth profile 3B) is obtained (FIG. 5C).

According to the present embodiment, the following effects can be obtained.

1) The structure is made such as to have the tooth profile metal mold 20 having the plural stages of tooth profile portions 21 to 23, and the holding metal mold 30 having one holding portion 31 commonly corresponding to the respective stages of tooth profile portions 21 to 23 in the tooth profile metal mold 20, and position the rear stage of tooth profile portions 22 and 23 in the tooth profile metal mold 20 with respect to the pipe forming body 1 in the state of holding the pipe forming body 1 formed by using the front stage of tooth profile portions 21 and 22 in the tooth profile metal mold 20 to the holding portion 31 of the holding metal mold 30. Accordingly, it is possible to smoothly repeat the tooth profile executed by the respective stages of tooth profile portions 21 to 23 while holding the pipe forming body to the common holding portion 31 in the holding metal mold 30, and it is possible to improve a productivity of the pipe rack 4.

2) Since the holding metal mold 30 has one holding portion 31 and this is made common to the respective stages of the tooth profile portions 21 to 23 in the tooth profile metal mold 20, it is possible to simplify the structure of the pipe rack forming apparatus 10.

Figure 7:
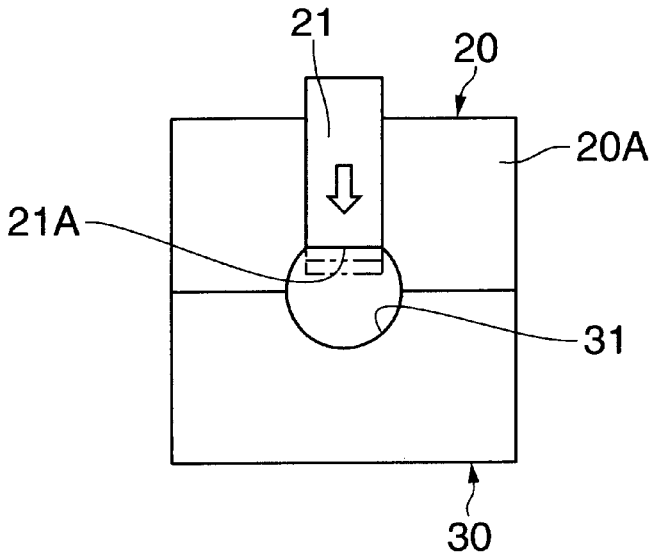
FIG. 7 is a front elevational view showing a tooth profile metal mold and a holding metal mold according to a third embodiment.
Figure 8:
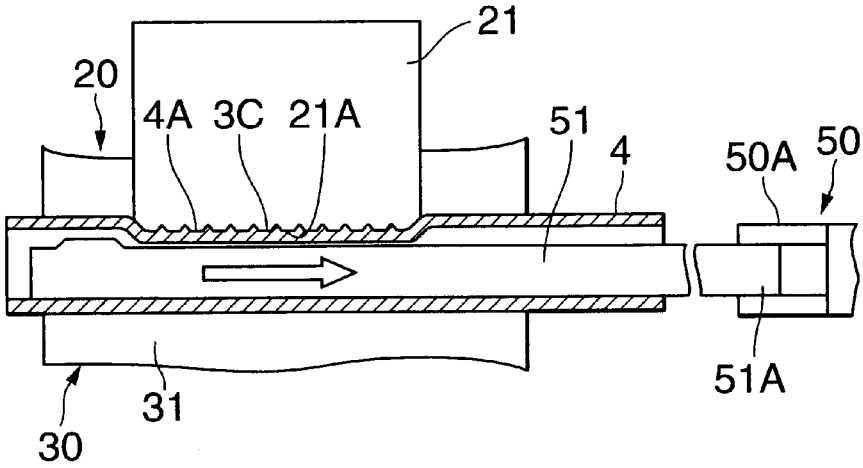
FIG. 8 is a schematic view showing a mandrel pressing and moving forward and backward apparatus according to the third embodiment.

(Third Embodiment) (FIGS. 7 and 8)

A pipe rack forming apparatus 10 according to a third embodiment is different from the pipe rack forming apparatus 10 according to the first embodiment in a point that the tooth profile metal mold 20 has only one tooth profile portion 21, which corresponds to the final tooth profile 3C, the holding metal mold 30 has only one holding portion 31, the mandrel pressing and moving forward and backward apparatus 50 has only one mandrel 51, the tooth profile metal mold 20 can displace the tooth profile portion 21 with respect to the tooth profile metal mold main body 20A, and a height position of the tooth bottom forming surface 21A of the tooth profile portion 21 can be controlled continuously or into a plurality of stages according to an ascending and descending motion of the pipe pressing and holding apparatus 14 (FIG. 7).

The tooth profile portion 21 of the tooth profile metal mold 20 is position controlled to respective position control stages (for example, first to third position control stages) in which the height position of the tooth bottom forming surface 21A with respect to the pipe forming body 1 (the intermediate pipe forming bodies 1A and 1B) is descended in sequence.

A forming procedure of the pipe rack 4 executed by the pipe rack forming apparatus 10 according to the third embodiment is as follows.

(1) The flat surface portion 2 is formed in a part of the raw pipe material, and the pipe forming body 1 is obtained (FIG. 3).

(2) In a state of holding the pipe forming body 1 by the holding portion 31 in the holding metal mold 30 and the tooth profile metal mold main body 20A in the tooth profile metal mold 20, the flat surface portion 2 of this pipe forming body 1 is pressed by the tooth bottom forming surface 21A in the tooth profile portion 21 of the tooth profile metal mold 20 positioned in the first position control stage by means of the pipe pressing and holding apparatus 14 so as to stamp. The tooth bottom forming surface 21A in the tooth profile portion 21 position controlled in the first position control stage can form the tooth profile 3A in which the tooth bottom forming height is largest and the tooth bottom height Ha is largest, as shown in FIG. 5A. A height formed by the inner peripheral surface 2A of the stamped flat surface portion 2 in the pipe forming body 1 with respect to the inner surface in the opposite side becomes lower than the height Hm of the mandrel 51.

(3) The mandrel 51 is pressure inserted to the inner periphery of the pipe forming body 1 which is pressed and held by the tooth profile metal mold main body 20A and the tooth profile portion 21 in the tooth profile metal mold 20 and the holding portion 31 in the holding metal mold 30 in the item (2) mentioned above by the mandrel pressing and moving forward and backward apparatus 50 so as to be pressed and moved forward and backward (be moved forward in the pressed state and be moved backward in the pressed state), and the wall of the flat surface portion 2 is casted up so as to be inserted to a recess portion between adjacent convex shapes in the tooth profile portion 21, whereby the tooth profile 3A having the tooth bottom height Ha is formed. Accordingly, a first intermediate pipe forming body 1A is obtained.

(4) The flat surface portion 2 (the tooth profile 3A) of the first intermediate pipe forming body 1A obtained according to the item (3) mentioned above is pressed by the tooth bottom forming surface 21A of the tooth profile portion 21 in the tooth profile metal mold 20 positioned in the second position control stage by means of the pipe pressing and holding apparatus 14 so as to be stamped. The tooth bottom forming surface 21A of the tooth profile portion 21 position controlled to the second position control stage can form a tooth profile 3B in which the tooth bottom forming height is second largest and the tooth bottom height Hb is second largest (the tooth bottom height Hb is lower than the tooth bottom height Ha of the tooth profile 3A), as shown in FIG. 5B. A height which an inner peripheral surface 2B of the stamped flat surface portion 2 in the first intermediate pipe forming body 1A forms with respect to the inner surface in the opposite side becomes lower than the height Hm of the mandrel 51.

(5) The mandrel 51 is pressure inserted to the inner periphery of the first intermediate pipe forming body 1A which is pressed and held by the tooth profile metal mold main body 20A and the tooth profile portion 21 in the tooth profile metal mold 20 and the holding portion 31 in the holding metal mold 30 in the item (4) mentioned above by the mandrel pressing and moving forward and backward apparatus 50 so as to be pressed and moved forward and backward (be moved forward in the pressed state and be moved backward in the pressed state), and the wall of the flat surface portion 2 (the tooth profile 3A) is casted up so as to be inserted to a recess portion between adjacent convex shapes in the tooth profile portion 21, whereby the tooth profile 3B having the tooth bottom height Hb is formed. Accordingly, a second intermediate pipe forming body 1B is obtained.

(6) The forming operations in the items (4) and (5) mentioned above are repeatedly applied to the second intermediate pipe forming body 1B obtained in the item (5) mentioned above, and the rack tooth 4A having the final tooth profile 3C is formed. According to the present embodiment, the tooth bottom forming surface 21A of the tooth profile portion 21 in the tooth profile metal mold 20 is positioned in the third position control stage, the flat surface portion 2 (the tooth profile 3B) of the second intermediate pipe forming body 1B is stamped by the tooth bottom forming surface 21A in the tooth profile portion 21 position controlled in the third position control stage in the state of being held by the holding metal mold 31, and the mandrel 51 is pressure inserted to the inner periphery of the second intermediate pipe forming body 1B (the inner peripheral surface 2C is lower than the height Hm of the mandrel 51) so as to be pressed and moved forward and backward (be moved forward in the pressed state and be moved backward in the pressed state), whereby the rack tooth 4A having the final tooth profile 3C of the tooth bottom height Hc (the tooth bottom height Hc is lower than the tooth bottom height Hb of the tooth profile 3B) is obtained.

In the step mentioned above according to the third embodiment, after the tooth bottom forming surface 21A of the tooth profile portion 21 positioned to each of the first, second and third position control stages stamps the flat surface portion 2 of the intermediate pipe forming body 1A (1B), the tooth profile is formed by pressure inserting the mandrel 51 so as to press and move forward and backward (move forward in the pressing state and move forward in the pressing state) in each case, thereby forming the tooth profile. However, it is also possible to form the tooth profile by alternately repeating the operation of moving the mandrel 51 forward in the pressing state or moving the mandrel 51 backward in the pressing state in a manner described in the following items (1) to (3), at each time when the tooth bottom forming surface 21A of the tooth profile portion 21 presses the pipe forming body 1 (the intermediate pipe forming bodies 1A and 1B). According to this structure, it is possible to intend to reduce manpower.

(1) The first intermediate pipe forming body 1A (the tooth profile 3A) is obtained by pressing and moving forward the mandrel 51 with respect to the pipe forming body 1, in a state of positioning the tooth bottom forming surface 21A of the tooth profile portion 21 in the first position control stage with respect to the pipe forming body 1 by the pipe pressing and holding apparatus 14.

(2) The flat surface portion 2 (the tooth profile 3A) of the first intermediate pipe forming body 1A is stamped by positioning the tooth bottom forming surface 21A of the tooth profile portion 21 to the second position control stage with respect to the first intermediate pipe forming body 1A by means of the pipe pressing and holding apparatus 14, in a state in which the mandrel 51 stands by at a pressing forward moving end in the item (1) mentioned above (FIG. 8). The second intermediate pipe forming body 1B (the tooth profile 3B) is obtained by pressing and moving backward the mandrel 51 with respect to the first intermediate pipe forming body 1A, in a state of positioning the tooth bottom forming surface 21A of the tooth profile portion 21 to the second position control stage in the manner mentioned above.

(3) The flat surface portion 2 (the tooth profile 3B) of the second intermediate pipe forming body 1B is stamped by positioning the tooth bottom forming surface 21A of the tooth profile portion 21 to the third position control stage with respect to the second intermediate pipe forming body 1B by means of the pipe pressing and holding apparatus 14, in a state in which the mandrel 51 stands by at a pressing backward moving end in the item (2) mentioned above. The rack tooth 4A having the final tooth profile 3C is obtained by pressing and moving forward the mandrel 51 with respect to the second intermediate pipe forming body 1B, in a state of positioning the tooth bottom forming surface 21A of the tooth profile portion 21 to the third position control stage in the manner mentioned above.

According to the present embodiment, the following effects can be obtained.

1) The tooth profile metal mold 20 can displace the tooth profile portion 21 with respect to the tooth profile metal mold main body 20A, and can control the height position of the tooth bottom forming surface 21A in the tooth profile portion 21. Further, at a time of pressing the flat surface portion 2 of the pipe forming body 1 by the tooth bottom forming surface 21A of the tooth profile portion 21 in the tooth profile metal mold 20, the tooth profile portion 21 of the tooth profile metal mold 20 controls the position of the tooth profile portion 21 so that the tooth bottom height applied to the flat surface portion 2 is reduced in sequence, and the mandrel 51 having the same size is repeatedly pressed and moved forward and backward (moved forward in the pressed state and moved backward in the pressed state) to the inner periphery of the pipe forming body 1 every time when the tooth profile portion 21 in the tooth profile metal mold 20 presses the flat surface portion 2. Accordingly, since it is possible to set a stamping amount of the pipe forming body 1 applied by the tooth profile portion 21 in the respective position control stages of the tooth profile metal mold 20 to be smallish without initially making the stamping amount excessive enough to correspond to the tooth bottom height of the final tooth profile 3C, it is not necessary to particularly reduce the diameter of the mandrel 51 pressure inserted to the inner periphery of the pipe forming body 1 stamped by the tooth profile portion 21 in the respective position control stages, and it is possible to prevent the mandrel 51 from being broken. It is possible to easily form the pipe rack 4 having a small diameter.

2) It is possible to intend to reduce the manpower by alternately repeating the operation of moving forward in the pressing state or moving backward in the pressing state the mandrel 51 having the same size into the inner periphery of the pipe forming body 1 (1A and 1B), at every time when the tooth profile portion 21 in the tooth profile metal mold 20 presses a part of the pipe forming body 1 (1A and 1B).

3) It is possible to employ the mandrel having the same size for the mandrel 51 pressure inserted to the inner periphery of the pipe forming body 1 pressed by the tooth profile portion 21 in the respective position control stages of the tooth profile metal mold 20. Whereby, it is possible to easily form the pipe rack 4.

4) It is possible to smoothly repeat the forming operation executed by the tooth profile portion 21 in the respective position control stages of the tooth profile metal mold 20 while holding the pipe forming body 1 by the holding body 31 in the holding metal mold 30 and the tooth profile metal mold main body 20A in the tooth profile metal mold 20, and it is possible to improve a productivity of the pipe rack 4.

5) It is sufficient that the tooth profile metal mold 20 and the holding metal mold 30 respectively have one tooth profile portion 21 and holding portion 31, and it is possible to simplify the structure of the pipe rack forming apparatus 10.

Figure 9:
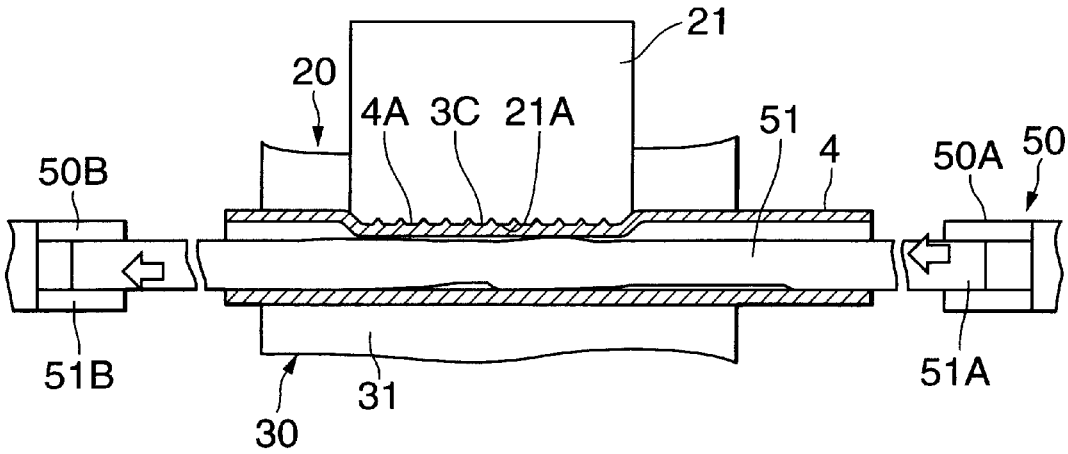
FIG. 9 is a schematic view showing a modified embodiment of the mandrel pressing and moving forward and backward apparatus.

Further, in the pipe rack forming apparatus 10, as shown in FIG. 9, the structure may be made such that the mandrel pressing and moving forward and backward apparatuses 50 (50A and 50B) are placed in both sides of the pipe pressing and holding apparatus 14, holding portions 51A and 51B provided in both of the forming convex portions in the mandrel 51 are held by a chuck or the like provided in plungers 54 of the mandrel pressing and moving forward and backward apparatuses 50A and 50B in both sides, and the mandrel 51 is pressed and moved forward and backward due to a cooperation effect of the mandrel pressing and moving forward and backward apparatuses 50A and 50B in both sides. According to this structure, the mandrel 51 is simultaneously exposed to a pressing force applied by one of the mandrel pressing and moving forward and backward apparatuses 50A and 50B, and a drawing force applied by another. Whereby, it is possible to intend to prevent the mandrel 51 from being broken.

As heretofore explained, embodiments of the present invention have been described in detail with reference to the drawings. However, the specific configurations of the present invention are not limited to the embodiments but those having a modification of the design within the range of the present invention are also included in the present invention. For example, the structure (FIG. 9) of holding both end portions of the mandrel by the mandrel pressing and moving forward and backward means in both sides so as to press and move forward and backward is not limited to be employed in the pipe rack forming apparatus 10 according to the third embodiment, but can be employed in the pipe rack forming apparatus 10 (the mandrels 51 to 53) according to the first embodiment and the second embodiment.

As mentioned above, according to the present invention, at a time of forming the pipe rack by using the tooth profile metal mold and the mandrel, it is possible to easily form the pipe rack while preventing the mandrel from being broken.

Although the invention has been illustrated and described with respect to several exemplary embodiments thereof, it should be understood by those skilled in the art that the foregoing and various other changes, omissions and additions may be made to the present invention without departing from the spirit and scope thereof. Therefore, the present invention should not be understood as limited to the specific embodiment set out above, but should be understood to include all possible embodiments which can be embodied within a scope encompassed and equivalents thereof with respect to the features set out in the appended claims.

What is claimed is:

1. A pipe rack forming method of forming a rack tooth having a final tooth profile of a fixed tooth bottom height and tooth top height, in a part of a pipe material comprising:

preparing a tooth profile metal mold having a plurality of tooth profile portions each having a different height position of tooth bottom forming surfaces;

holding a raw pipe material by a holding portion of a holding metal mold, sequentially pressing the tooth profile portions in which the tooth bottom height applied to a part of the raw pipe material is reduced in sequence repeatedly pressing and a moving forward and backward a mandrel, the mandrel having the same size every time, to an inner periphery of the raw pipe material when the tooth profile portions in the tooth profile metal mold press a part of the raw pipe material, and forming a rack tooth having a final tooth profile.

2. A pipe rack forming apparatus used for executing the pipe rack forming method according to claim 1, comprising:

a tooth profile metal mold having a plurality of stages of tooth profile portions;

a holding metal mold having a plurality of stages of holding portions individually corresponding to the respective stages of tooth profile portions in the tooth profile metal mold;

a pipe pressing and holding means for pressing and holding a raw pipe material between the holding portion in the holding metal mold and the tooth profile portion in the tooth profile metal mold in each of the stages; and a mandrel pressing and moving forward and backward means for pressing and moving forward and backward the mandrel to an inner periphery of the raw pipe material, wherein the raw pipe material formed by using the a front stage of the tooth profile portion in the tooth profile metal mold is transferred between the holding portion in a rear stage of the holding metal mold and the tooth profile portion in the tooth profile metal mold and is pressed and held by the pipe pressing and holding means, and the mandrel is pressed and moved forward and backward in the raw pipe material by the mandrel pressing and moving and backward means.

3. A pipe rack forming apparatus according to claim 2, wherein the mandrel pressing and moving forward and backward means comprises a first means and a second mean and the first means is placed in a first side of the pipe pressing and holding means and the second means is placed in a second side of the pipe pressing and holding means, and both of the mandrel pressing and moving forward and backward means hold end portions of the mandrel so as to press and move forward and backward the mandrel.

4. A pipe rack forming apparatus used for executing the pipe rack forming method according to claim 1, comprising:

a tooth profile metal mold having a plurality of stages of tooth profile portions;

a holding metal mold having one holding portion commonly corresponding to the respective stages of tooth profile portions in the tooth profile metal mold;

a pipe pressing and holding means for pressing and holding a raw pipe material between the common holding portion in the holding metal mold and the tooth profile portion of each of the stages of tooth profile metal molds; and a mandrel pressing and moving forward and backward means for pressing and moving forward and backward the mandrel in an inner periphery of the raw pipe material, wherein a rear stage of a forming portion in a forming metal mold is positioned with respect to the raw pipe material so as to be pressed and held by the pipe pressing and holding means while holding the raw pipe material formed by using a front stage of the tooth profile portion in the tooth profile metal mold in the holding portion in the holding metal mold, and the mandrel is pressed and moved forward and backward in the raw pipe material by the mandrel pressing and moving forward and backward means.

5. A pipe rack forming apparatus according to claim 4, wherein the mandrel pressing and moving forward and backward means comprises a first means and a second mean and the first means is placed in a first side of the pipe pressing and holding means and the second means is placed in a second side of the pipe pressing and holding means, and both of the mandrel pressing and moving forward and backward means hold end portions of the mandrel so as to press and move forward and backward the mandrel.

6. A pipe rack forming method of forming a rack tooth having a final tooth profile of a fixed tooth bottom height and tooth top height, in a part of a raw pipe material comprising:

using a tooth profile metal mold in which a tooth profile portion capable of being displaced with respect to a tooth profile metal mold main body, and a height position of a tooth bottom forming surface in the tooth profile portion is capable of being controlled, holding a raw pipe material by a holding portion of a holding metal mold and the tooth profile metal mold body, pressing a part of the raw pipe material by the tooth bottom forming surface of the tooth profile portion in the tooth profile metal mold, position controlling the tooth profile portion so that the tooth bottom height applied to a part of the raw pipe material is reduced in sequence, repeatedly pressing and moving forward and backward a mandrel, the mandrel having the same size every time, to an inner periphery of the raw pipe material when the tooth profile portion in the tooth profile metal mold presses the part of the raw pipe material, and forming a rack tooth having a final tooth profile.

7. A pipe rack forming apparatus used for executing the pipe rack forming method according to claim 6, comprising:

a tooth profile metal mold capable of displacing a tooth profile portion with respect to a tooth profile metal mold main body and capable of controlling a height position of a tooth bottom forming surface in the tooth profile portion;

a holding metal mold having a holding portion corresponding to the tooth profile portion in the tooth profile metal mold;

a pipe pressing and holding means for pressing and holding a raw pipe material between the holding portion in the holding metal mold, the tooth profile metal mold main body and the tooth profile portion in the tooth profile metal mold; and a mandrel pressing and moving forward and backward means for pressing and moving forward and backward the mandrel in an inner periphery of the raw pipe material.

8. A pipe rack forming apparatus according to claim 7, wherein the mandrel pressing and moving forward and backward means comprises a first means and a second mean and the first means is placed in a first side of the pipe pressing and holding means and the second means is placed in a second side of the pipe pressing and holding means, and both of the mandrel pressing and moving forward and backward means hold end portions of the mandrel so as to press and move forward and backward the mandrel.

9. A pipe rack forming method of forming a rack tooth having a final tooth profile of a fixed tooth bottom height and tooth top height, in a part of a raw pipe material comprising:

using a tooth profile metal mold in which a tooth profile portion capable of being displaced with respect to a tooth profile metal mold main body, and a height position of a tooth bottom forming surface in the tooth profile portion is capable of being controlled, holding a raw pipe material by a holding portion of a holding metal mold and the tooth profile metal mold body, pressing a part of the raw pipe material by the tooth bottom forming surface of the tooth profile portion in the tooth profile metal mold, position controlling the tooth profile portion so that the tooth bottom height applied to a part of the raw pipe material by is reduced in sequence, alternatively repeating an operation of moving forward in a pressing state and moving backward in a pressing state a mandrel, the mandrel having the same size every time, to an inner periphery of the raw pipe material when the tooth profile portion in the tooth profile metal mold presses the part of the raw pipe material, and forming a rack tooth having a final tooth profile.

10. A pipe rack forming apparatus used for executing the pipe rack forming method according to claim 9, comprising:

a tooth profile metal mold capable of displacing a tooth profile portion with respect to a tooth profile metal mold main body and capable of controlling a height position of a tooth bottom forming surface in the tooth profile portion;

a holding metal mold having a holding portion corresponding to the tooth profile portion in the tooth profile metal mold;

a pipe pressing and holding means for pressing and holding a raw pipe material between the holding portion in the holding metal mold, the tooth profile metal mold main body and the tooth profile portion in the tooth profile metal mold; and a mandrel pressing and moving forward and backward means for pressing and moving forward and backward the mandrel in an inner periphery of the raw pipe material.

11. A pipe rack forming apparatus according to claim 10, wherein the mandrel pressing and moving forward and backward means comprises a first means and a second mean and the first means is placed in a first side of the pipe pressing and holding means and the second means is placed in a second side of the pipe pressing and holding means, and both of the mandrel pressing and moving forward and backward means hold end portions of the mandrel so as to press and move forward and backward the mandrel.

* * * * *